US006689993B2

(12) United States Patent
Säynäväjärvi

(10) Patent No.: US 6,689,993 B2
(45) Date of Patent: Feb. 10, 2004

(54) METHOD AND DEVICE FOR INDUCTION HEATING A ROLL

(75) Inventor: Risto Säynäväjärvi, Söderkulla (FI)

(73) Assignee: Metso Automation Oy, Helsinki (FI)

( * ) Notice: Subject to any disclaimer, the term of this patent is extended or adjusted under 35 U.S.C. 154(b) by 0 days.

(21) Appl. No.: 10/091,228

(22) Filed: Mar. 5, 2002

(65) Prior Publication Data

US 2002/0121353 A1 Sep. 5, 2002

(30) Foreign Application Priority Data

Mar. 5, 2001 (FI) ..... 20010423

(51) Int. Cl.[7] ..... H05B 6/14; D21F 5/16

(52) U.S. Cl. ..... 219/619; 219/656; 219/672; 219/676; 219/662; 100/301; 100/329

(58) Field of Search ..... 219/619, 656, 219/655, 662, 671, 672, 676; 100/38, 301, 320, 328, 329, 332, 334

(56) References Cited

U.S. PATENT DOCUMENTS

| | | | | | |
|---|---|---|---|---|---|
| 2,761,941 | A | * | 9/1956 | Ardichvili | 219/619 |
| 4,425,489 | A | | 1/1984 | Pav et al. | 219/10.49 A |
| 4,614,565 | A | | 9/1986 | Rihinen | 162/206 |
| 4,675,487 | A | * | 6/1987 | Verkasalo | 219/619 |
| 4,384,514 | A | | 8/1989 | Larive et al. | 100/38 |
| 5,074,019 | A | | 12/1991 | Link | 29/116.2 |
| 5,713,069 | A | * | 1/1998 | Kato | 219/619 |
| 5,895,598 | A | | 4/1999 | Kitano et al. | 219/619 |
| 6,289,797 | B1 | | 9/2001 | Ijas | 100/38 |

FOREIGN PATENT DOCUMENTS

| | | | | |
|---|---|---|---|---|
| EP | 196264 | | 10/1986 | |
| EP | 0276203 | | 7/1988 | |
| EP | 277905 | | 8/1988 | |
| EP | 0337973 | | 10/1989 | |
| JP | 6-267651 | * | 9/1994 | 219/619 |

* cited by examiner

*Primary Examiner*—Philip H. Leung
(74) *Attorney, Agent, or Firm*—Steinberg & Raskin, P.C.

(57) ABSTRACT

A device for heating a roll in a paper or paperboard machine or in a finishing machine for paper or paperboard the device including a profiling induction heater (5) which is arranged to heat the roll (3) with a power dependent on the location of the point to be heated in the axial direction of the roll, and a non-profiling induction heater (4) which, to provide basic heating, is arranged to heat the same roll (3) with a heating power which is substantially even over the width of the roll (3). The profiling induction heater (5) and the non-profiling induction heater (4) are placed in the same support structure (1) outside the roll (3). The roll (3) is a calender roll.

10 Claims, 1 Drawing Sheet

METHOD AND DEVICE FOR INDUCTION HEATING A ROLL

FIELD OF THE INVENTION

The invention relates to a method for heating a roll, and in particular to a method of heating a roll in which the roll is heated at different points along the axial length of the roll to achieve a heating profile along the roll. The invention also relates to a device for heating a roll, and in particular to a device for heating a roll which is equipped with a profiling induction heater. Furthermore, the invention relates to a method for rebuilding a heating system of a roll, and in particular to a method for rebuilding a heating system in which the existing heating system includes a profiling induction heater.

BACKGROUND OF THE INVENTION

In paper or paperboard machines or finishing machines for paper or paperboard, rotating rolls are used for treating the paper web. Such rolls are used especially in calenders, wherein linear load and/or heat is exerted on the web passing by the roll to treat the web in the desired manner. The calender may be placed either in the production line of paper, wherein it treats the web coming from the drying section of the paper machine, or it may be located in a separate paper finishing machine, wherein the processed paper web is unwound from reels. Other rolls that treat the web by means of heat and/or pressure, include rolls of the press section and drying cylinders of the drying section.

The calender roll is arranged rotatable in the frame of the calender in such a manner that it forms a so-called calender nip with the moving surface of a counter element, wherein the paper web to be processed is guided through this nip. The counter element on the other side of the nip may be another rotating calender roll but also a continuous belt passed via a roll or a stationary supporting surface. In its simplest form, the calender may be formed of one nip, but it may also consist of two or more nips, which each can be formed between a calender roll and an opposite moving element. To produce successive nips in the travel direction of the web, the pairs of a calender roll and a counter element may be separate units in the frame of the calender, or a so-called roll stack may be formed of the calender rolls, wherein the web travels along a winding path via the nips formed between the rolls.

The calendering nip may be formed between two hard surfaces, for example between two smooth-faced metal rolls, or between a hard surface and a soft surface, wherein the latter is typically attained with a soft cover in a metal-faced roll or by means of an elastic belt passed over the roll or a stationary shoe element.

It is common in all the aforementioned solutions to heat a metal-covered roll, and there are many alternatives for heating the roll, such as a heating medium fed inside the roll, radiation heating by means of heating elements outside or inside the roll, or induction heating by means of a magnetic field with induction coils arranged inside or outside the roll.

Examples of induction heating are disclosed for example in Finnish patent 71375 and in the corresponding U.S. Pat. No. 4,614,565, Finnish publication 74825 and in the corresponding U.S. Pat. No. 4,384,514 as well as in the European patent 196 264. These publications disclose induction heating by means of electromagnetic coils i.e. induction coils arranged outside the shell of the roll. It is also possible to conduct the heating by controlling each roll separately, wherein temperature profiling can be attained, by means of which it is also possible to affect the nip profile through thermal expansion of metal. U.S. Pat. No. 4,384,514 presents coils arranged in two rows which are placed in a staggered relationship so that their areas of influence cover the the heated width of the roll shell, to perform the heating in a profiled manner by adjusting each coil separately.

An induction heater that is arranged inside a rotating roll and exerts a magnetic field on the shell of the roll is, in turn, disclosed in U.S. Pat. Nos. 4,425,489, 5,074,019 and 5,895,598. The electromagnetic coils located in the induction heater may be independently controllable to perform the induction heating in a profiled manner. U.S. Pat. No. 5,074,019 presents a solution, in which the shell of the roll is heated by induction heaters both inside and outside, and the aim is thus to provide as even heating as possible and to avoid an uneven surface temperature of the roll (column 5, lines 67 to 68, of the publication).

Furthermore, U.S. Pat. No. 6,289,797 and corresponding German patent application 19911963 disclose the possibility of placing zonewise controlled induction coils inside a polymer-coated calender roll.

European patent 277905 discloses a non-profiling external induction heater in connection with a calender roll equipped with an internal heating medium.

Thus, electromagnetic coils, i.e. induction coils are commonly used for heating of the outer surface of rotating rolls in a paper machine or a finishing machine for paper up to a fixed temperature by producing eddy currents in the shell of the roll by means of induction, said eddy currents heating the shell of the roll in such a manner that the outer surface of the shell that is in contact with the web, reaches a predetermined temperature.

Thus, it is well-known to use induction heaters for heating calender rolls in such a manner that, as a result of locally adjusted thermal expansion of the shell of the roll, the desired nip profile and thereby the adjustment of the thickness profile of paper passed through the nip is attained. Profiling induction heaters, which are disclosed for example in the aforementioned publications, are also well-known. Furthermore, it is known to use such induction heaters for profiling heating of calender rolls which are equipped with an internal heating medium.

In calenders as well as in other possible objects in a paper or paperboard machine or in a finishing machine for paper or paperboard, in which it is possible to use induction heating of the roll, there is a lack of space due to the compact structure and the lay-out and the variety of auxiliary devices required in the process. Therefore, it is of primary importance that the profiling induction heater can, first of all, be constructed to be very compact.

OBJECTS AND SUMMARY OF THE INVENTION

It is an aim of the invention to present a method whereby the above-mentioned disadvantages can be eliminated in such a way that the roll can be effectively heated with solutions which take little space.

In the method according to the invention the basic heating of the roll is effected by unprofiling heating outside the roll. In addition to this, the same roll is subjected to profiling induction heating. In a calender application, this profiling heating can be coupled to an automatic caliper adjustment (adjustment of the nip profile). Previously, profiling induction heating has also been used for basic heating, wherein it has been necessary to make the profiling induction heater large.

Another aim of the invention is to introduce a device by means of which it is possible to implement precise heating of the rolls with induction heaters.

The device according to the present invention comprises both a non-profiling heater outside the roll, which heater achieves even basic heating of the roll, and a profiling induction heater. Both heaters are preferably placed outside the roll, one after the other in the direction of rotation of the roll. Each heater can be controlled and adjusted separately. The primary variable to be controlled/adjusted for the non-profiling heater is a given heating effect, and the variable to be controlled/adjusted for the profiling heater is a given temperature profile. The non-profiling heater can be integrated in the same compact support structure, e.g. a beam structure, as the profiling heater.

The non-profiling even heater is preferably also an induction heater. In this way, it is possible to completely eliminate heating by means of a heat transfer medium, such as hot oil, which requires tube arrangements in the roll structure. Similarly, it is easier to implement the adjustment and control when the heatings of the roll are effected by the same principle.

In the method for rebuilding a system for heating a roll according to the invention a heating system which already comprises a profiling induction heater is provided with a supplementary non-profiling heater. If necessary, it is also possible to replace the roll itself; for example, a roll equipped with the circulation of a heating medium can be replaced with a roll of another type which does not contain internal heating medium channels.

BRIEF DESCRIPTION OF THE DRAWINGS

In the following, the invention will be described in more detail with reference to the appended drawings, in which.

DETAILED DESCRIPTION OF THE INVENTION

Figure 1:
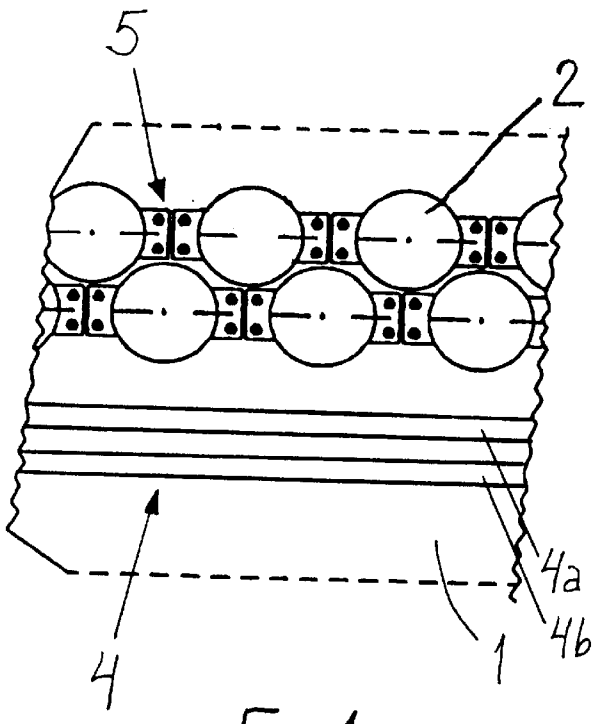
FIG. 1 shows a front-view of the device according to the invention.

FIG. 1 shows the device in a front-view, i.e. seen in the direction of the radius of the heated roll. The device comprises an elongate supporting structure 1 extending in the cross direction of the web, "an induction heating beam", on which induction coils 2 of equal size are placed at fixed intervals. The induction coils are circular in the cross-section taken in the axial plane. To even out the points of discontinuity resulting from the distances between the coils, the coils 2 are staggered in such a manner that they are located in two parallel rows so that the coils in the second row are positioned between the coils in the first row. The induction coils 2 are placed so that their areas of influence overlap each other partly.

Figure 2:
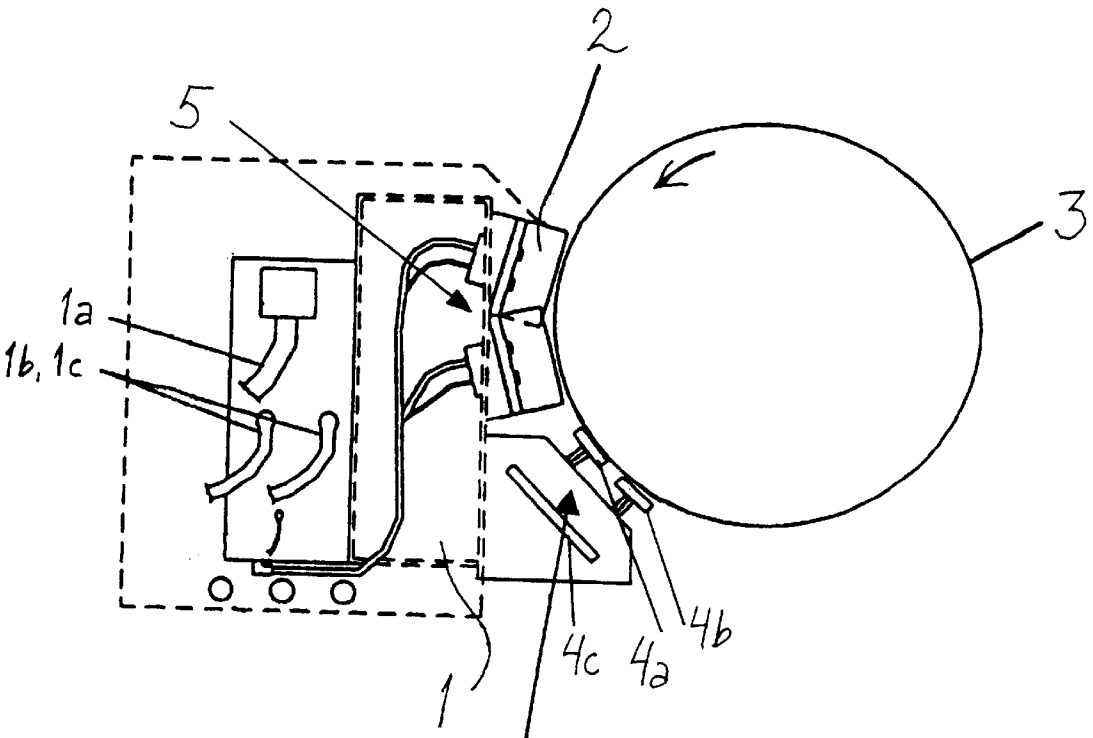
FIG. 2 shows a side-view of the device placed in connection with a heated roll.

FIG. 2 shows the device according to FIG. 1 in a side view, positioned in connection with a rotating roll 3 in a paper or paperboard machine or a finishing machine for paper or paperboard. The supporting structure 1 is marked with broken lines, and it may also contain switch cabinets for electric couplings of the induction coils 2. As can be seen in FIG. 2, the induction coils 2 are positioned close to the surface of the heated roll 3 in such a manner that only a narrow air gap remains therebetween. The induction coils 2 are directed towards the surface of the roll 3 so that their central axis coincides with the radius of the roll. Thus, the induction heaters at different locations in the direction of the periphery of the roll are positioned at different angles with respect to each other. As can be seen in FIG. 2, the coils are located obliquely with respect to each other in such a manner that the coils in the second row partly fit between the coils in the first row. Furthermore, a main cable 1*a* to supply electric energy required in the induction heating and to distribute it to different induction coils, and connections 1*b*, 1*c* for supplying and discharging a cooling medium, e.g. water, are also led to the supporting structure 1. According to a known principle, the roll 3 is heated as a result of the eddy currents induced in the roll 3 while the roll rotates and moves past the induction heater.

The induction coils 2, located at different positions in the axial direction of the roll, constitute a profiling induction heater 5, by means of which the roll 3 is heated in a profiling manner, in other words, the heating effect varies in the axial direction of the roll. In practice, this can be implemented by adjusting the power of different induction coils 2 independently.

In addition to the profiling induction heater 5, the device shown in FIGS. 1 and 2 comprises an induction heater 4 which is located at a different position in the direction of rotation of the roll 3 than the induction coils 2 which achieve the profiling heating. This induction heater 4 is also placed to extend across the web, and it effects heating evenly over the whole width of the roll 3. This is basic heating of the roll 3 which is implemented with non-profiling induction heating. It is typical of this heating that the heating effect is not dependent on the location of the point to be heated in the axial direction of the roll, contrary to the solution implemented with the induction coils 2.

The induction heater 4 is used to supply basic heating in order to provide the roll with a given temperature level by the joint effect of the profiling induction heater 5 and the even heater 4. The combination is well suited for cases in which the surface temperature of the roll, at least at some points, exceeds 140° C.

The induction heater 4 is preferably integrated in the same support structure or induction heating beam on which the induction coils 2 of the profiling heater 5 are placed. In this way, a compact unit can be accomplished, in which both the induction heater 4 providing the basic heating and the induction coils 2 providing the profiling heating are placed outside the roll 3, close to its surface, in a sector of less than 120° measured along the outer perimeter of the roll.

The induction heater 4 providing even heating may comprise, for example, a current conductor loop placed in the axial direction of the roll 3 and coupled to an electric power supply, the branches of the conductor loop in the axial direction being indicated with the references 4*a* and 4*b*. The loop is equipped with a circulation of a cooling medium, such as water. It can be, for example, a copper conductor with an internal cooling channel. Due to the structure of the loop, the heating effect is even over the whole width of the roll. A reflector, provided behind the loop for better directing of the magnetic field to the shell of the roll 3, is indicated with the reference 4*c*. It is also possible to use other conductor structures.

Thanks to the invention, it is possible to fit both the effective basic heating of the roll 3, or the "bulk heating", and the precise temperature profiling in a small space. A significant advantage is that the induction coils 2 of the profiling induction heater 5 can be made smaller, because they do not need to be used for basic heating of the roll. Thanks to the invention, it is also possible to improve the profiling precision.

It is possible to place a non-profiling induction heater 4 afterwards, in connection with machine rebuilds, in a calender which is already equipped with profiling induction heating. The non-profiling heater 4 can be mounted, for example, in the same support structure 1, in which the profiling induction coils 2 are mounted.

The invention is not restricted to the embodiments described above, but it can be modified within the scope of the inventive idea presented by the appended claims. At least the profiling heating is effected by the principle of induction. For example, it is possible that the profiling heating is implemented with separate induction coils 2, whereas for even non-profiling heating over the whole width of the roll, a heater operated by another principle is used, such as an infrared heater (IR heater) or a heater placed outside the roll and operated by the principle of convection, for example by hot air. Such a heater is arranged to exert an effect over the whole width of the roll in such a way that when a given power is input to the heater, the heating response produced by the heater in the roll is not dependent on the location of the point to be heated in the axial direction of the roll. Such a non-profiling heater can also be integrated in the same support structure 1 as the induction coils 2. According to an advantageous embodiment, both of the heaters 4, 5 are operated by the principle of induction.

Furthermore, it is possible that the profiling induction heater is placed inside the roll to heat the roll shell from the inside, and the non-profiling basic heater is placed outside the roll. In view of the structure, however, the most advantageous solution is to place both of the heaters outside the roll and close to each other, as shown in FIGS. 1 and 2.

The roll 3 shown in FIG. 2 can be, for example, a calender roll which forms a calender nip with a counter element, e.g. another roll, through which nip the paper or paperboard web is passed to calender the same. The invention is not, however, restricted to calenders, but it can also be applied to induction heating, advantageously to profiling heating, preferably profiling induction heating, of other such rolls which enter in contact with a continuous web travelling in a paper or paperboard machine or finishing machine for paper or paperboard.

I claim:

1. A method for heating a roll in a paper or paperboard machine or in a finishing machine for paper or paperboard comprising the steps:

providing a profiling induction heater;

heating the roll by means of said profiling induction heater at different points along the axial direction of the roll with different amounts of power to achieve a profiling induction heating;

providing a non-profiling heater;

heating outside the roll (3), by means of said non-profiling heater, using heating power which is substantially even over the width of the roll; and wherein said profiling induction heater and said non-profiling heater are both placed in the same support structure (1).

2. The method according to claim 1, wherein the profiling induction heating is effected outside the roll (3).

3. The method according to claim 1, wherein the profiling induction heating is effected by several induction coils (2) at various locations in the axial direction of the roll (3).

4. The method according to claim 1, wherein also the basic heating of the roll (3) is effected by the principle of induction.

5. The method according to claim 1, wherein it is used for heating a calender roll.

6. A device for heating a roll in a paper or paperboard machine or in a finishing machine for paper or paperboard comprising:

a profiling induction heater (5) which is arranged to heat the roll (3) with a power dependent on the location of the point to be heated in the axial direction of the roll, a non-profiling heater (4) placed outside the roll and arranged to heat the same roll (3) with a heating power which is substantially even over the whole width of the roll; and wherein both of the heaters (4, 5) are placed in the same support structure (1).

7. The device according to claim 6, wherein the profiling induction heater (5) is placed outside the roll (3).

8. The method according to claim 6, wherein the profiling induction heater (5) comprises a plurality of induction coils (2) placed at various locations in the axial direction of the roll (3).

9. The device according to claim 6, wherein the non-profiling heater (4) is an induction heater as well.

10. A method for rebuilding the heating system in a paper or paperboard machine or in a finishing machine for paper or paperboard, wherein the heating system comprises a profiling induction heater (5) which is arranged to heat the roll (3) with a power dependent on the location of the point to be heated in the axial direction of the roll, said method for rebuilding comprising the steps of:

supplementing the heating system with a non-profiling heater (4), which is placed outside the roll and is arranged to heat the same roll (3) with a heating power which is substantially even over the whole width of the roll; and wherein the non-profiling heater (4) is integrated in an existing support structure (1) for the profiling induction heater (5).

* * * * *